US010923302B2

(12) United States Patent
Ogiya et al.

(10) Patent No.: US 10,923,302 B2
(45) Date of Patent: Feb. 16, 2021

(54) SWITCHGEAR

(71) Applicant: Mitsubishi Electric Corporation, Tokyo (JP)

(72) Inventors: Takahiro Ogiya, Tokyo (JP); Shinichiro Nakauchi, Tokyo (JP); Ryo Kamimae, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/641,721

(22) PCT Filed: Sep. 28, 2017

(86) PCT No.: PCT/JP2017/035277
§ 371 (c)(1),
(2) Date: Feb. 25, 2020

(87) PCT Pub. No.: WO2019/064447
PCT Pub. Date: Apr. 4, 2019

(65) Prior Publication Data
US 2020/0219687 A1 Jul. 9, 2020

(51) Int. Cl.
*H01H 33/40* (2006.01)
*H01H 33/42* (2006.01)

(52) U.S. Cl.
CPC ..... *H01H 33/42* (2013.01); *H01H 33/40* (2013.01)

(58) Field of Classification Search
CPC ..... H01H 33/42; H01H 33/40; H01H 31/003; H01H 31/32; H01H 5/02; H01H 5/08
(Continued)

(56) References Cited

U.S. PATENT DOCUMENTS 3,876,846 A * 4/1975 Graybill ..... H02B 13/075 218/68
3,987,260 A * 10/1976 Wilson ..... H02B 13/075 218/79
(Continued)

FOREIGN PATENT DOCUMENTS

DE 1118315 B 11/1961
JP H07249356 A 9/1995
(Continued)

OTHER PUBLICATIONS

International Search Report (PCT/ISA/210) dated Dec. 12, 2017, by the Japan Patent Office as the International Searching Authority for International Application No. PCT/JP2017/035277.
(Continued)

*Primary Examiner* — William A Bolton
(74) *Attorney, Agent, or Firm* — Buchanan Ingersoll & Rooney PC

(57) ABSTRACT

A switchgear includes a movable part capable of reciprocating movement, a movable contact coupled to the movable part and capable of reciprocating movement relative to the movable part, a biasing member that biases the movable contact, a latch capable of switching between a first state in which movement of the movable contact in the first direction is restricted and a second state in which movement of the movable contact in the first direction is permitted, and a fixed contact provided on a side of the first direction with respect to the movable contact. When the movable part and the movable contact move in a first direction, after movement for a predetermined distance, the movement of the movable contact is restricted by the latch in the first state, and then, when the movable part has moved further in the first direction, the latch is switched to the second state.

6 Claims, 6 Drawing Sheets

(58) Field of Classification Search
USPC ..... 218/84, 23, 55, 56, 79, 80, 87, 100, 12, 218/13, 45, 62, 68
See application file for complete search history.

(56) References Cited

U.S. PATENT DOCUMENTS 4,413,166 A * 11/1983 Meyer ..... H02B 13/075 218/80
4,484,047 A * 11/1984 Olsen ..... H01H 33/245 218/84
5,045,652 A * 9/1991 Yanabu ..... H01H 31/32 218/116
5,534,673 A * 7/1996 Lehmann ..... H01H 9/04 218/68
6,946,613 B2 * 9/2005 Otsuka ..... H01H 31/003 218/7
7,919,720 B2 * 4/2011 Shimizu ..... H01H 33/90 218/62
2009/0166168 A1 7/2009 Nakauchi et al.
2014/0346147 A1 11/2014 Blanchet et al.

FOREIGN PATENT DOCUMENTS

JP 2009163946 A 7/2009
JP 2010027479 A 2/2010
JP 2015505130 A 2/2015

OTHER PUBLICATIONS

Written Opinion (PCT/ISA/237) dated Dec. 12, 2017, by the Japan Patent Office as the International Searching Authority for International Application No. PCT/JP2017/035277.

* cited by examiner

SWITCHGEAR

FIELD

The present invention relates to a switchgear that includes a fixed contact and a movable contact.

BACKGROUND

In a switchgear, a circuit is connected and disconnected by contact and separation between a fixed contact and a movable contact. Examples of switchgears include a grounding switch used for grounding a main circuit when checking equipment. As described in Patent Literature 1, for grounding a main circuit, a movable contact on the grounding side is moved to be brought into contact with a fixed contact on the main circuit side. For bringing the movable contact into contact with the fixed contact, the main circuit is disconnected in advance in a state in which no voltage is applied to the fixed contact.

CITATION LIST

Patent Literature

Patent Literature 1: Japanese Patent Application Laid-open No. 2009-163946

SUMMARY

Technical Problem

Some of such switchgears are required to be reliable in that connection is safely achieved even in a case where the movable contact is erroneously brought into contact with the fixed contact in a state in which the main circuit is closed without being disconnected. In order to achieve the reliability, the duration of an arc occurring between the movable contact and the fixed contact needs to be shortened. Thus, the movable contact is moved at high speed in an attempt to shorten the time from formation of an arc until the movable contact comes in contact with the fixed contact. In order to move the movable contact at high speed, an operating device that generates a large driving force is needed. The increase in the size of the operating device is therefore a problem.

The present invention has been made in view of the above, and an object thereof is to provide a switchgear capable of shortening the duration of an arc while reducing the size of an operating device.

Solution to Problem

To solve the aforementioned problems and achieve the object, a switchgear according to the present invention includes: a movable part capable of reciprocating movement including movement in a first direction and movement in a second direction opposite to the first direction, a movable contact coupled to the movable part on a side of the first direction and capable of reciprocating movement toward the first direction and the second direction relative to the movable part, a first biasing member that biases the movable contact in the first direction relative to the movable part, a latch part capable of switching between a first state in which movement of the movable contact in the first direction is restricted and a second state in which movement of the movable contact in the first direction is permitted, and a fixed contact provided on a side of the first direction with respect to the movable contact. The movable part and the movable contact move in the first direction from initial positions at which the movable contact is away from the fixed contact to closed positions at which the movable contact is in contact with the fixed contact, and in a process in which the movable part and the movable contact move from the initial positions to the closed positions, after the movable part and the movable contact have moved a predetermined distance, the movement of the movable contact is restricted by the latch part in the first state, and when the movable part has moved further in the first direction against biasing force of the first biasing member after the movement of the movable contact was restricted, the latch part is switched to the second state in which the movement of the movable contact in the first direction is permitted. The latch part includes a magnet and a metallic member, the metallic member being attracted by the magnet from a side of the first direction when the movable part and the movable contact are at the initial positions. The movable contact includes an abutment portion that comes into contact with part of the metallic member avoiding the magnet from a side of the second direction when the movement of the movable contact in the first direction is restricted by the latch part. The switchgear further comprises a second biasing member that biases the metallic member in the second direction.

Advantageous Effects of Invention

A switchgear according to the present invention provides an effect of shortening the duration of an arc while reducing the size of an operating device.

DESCRIPTION OF EMBODIMENTS

A switchgear according to certain embodiments of the present invention will be described in detail below with reference to the drawings. Note that the present invention is not limited to the embodiments.

First Embodiment

Figure 1:
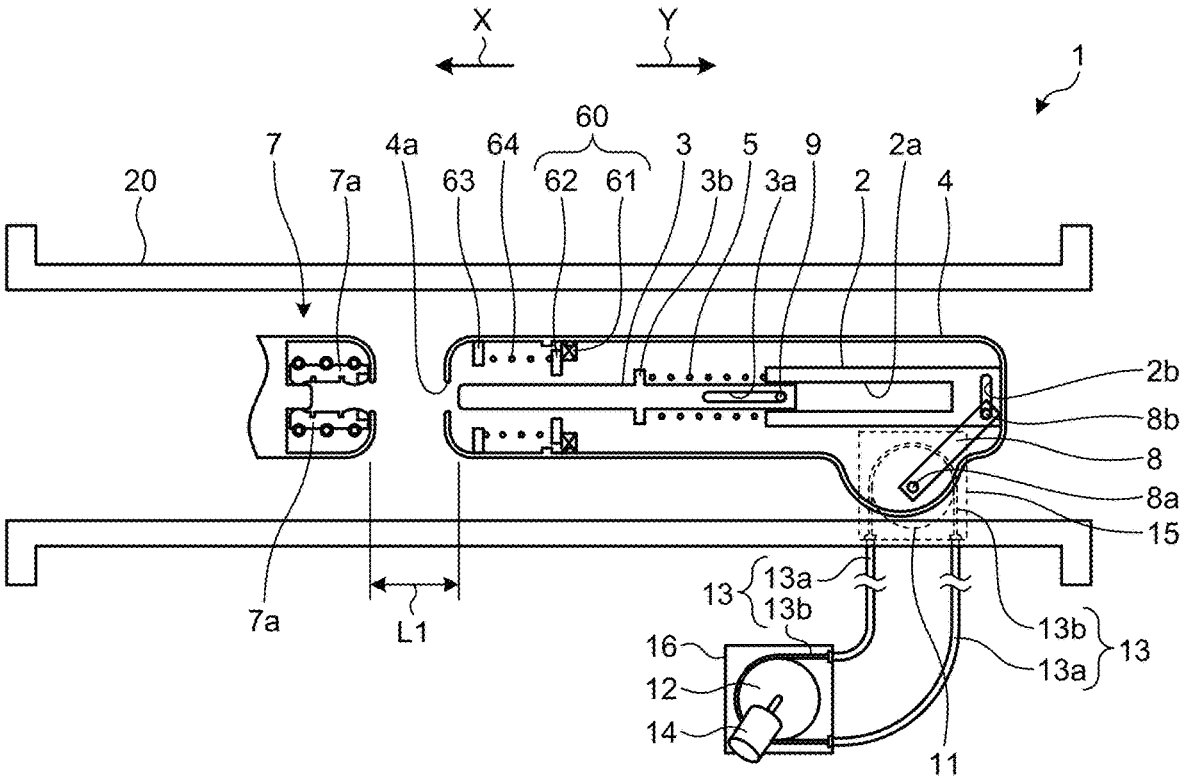
FIG. 1 is a cross-sectional view illustrating a schematic configuration of a switchgear according to a first embodiment of the present invention.
Figure 2:
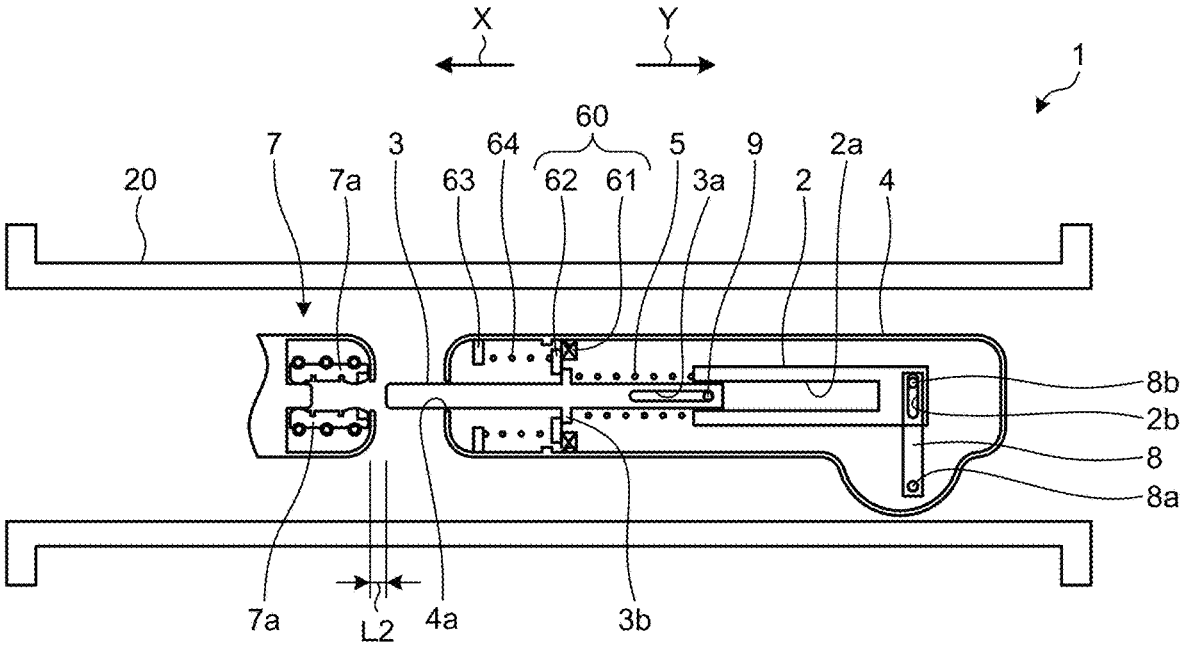
FIG. 2 is a cross-sectional view explaining closing operation in the switchgear according to the first embodiment.
Figure 3:
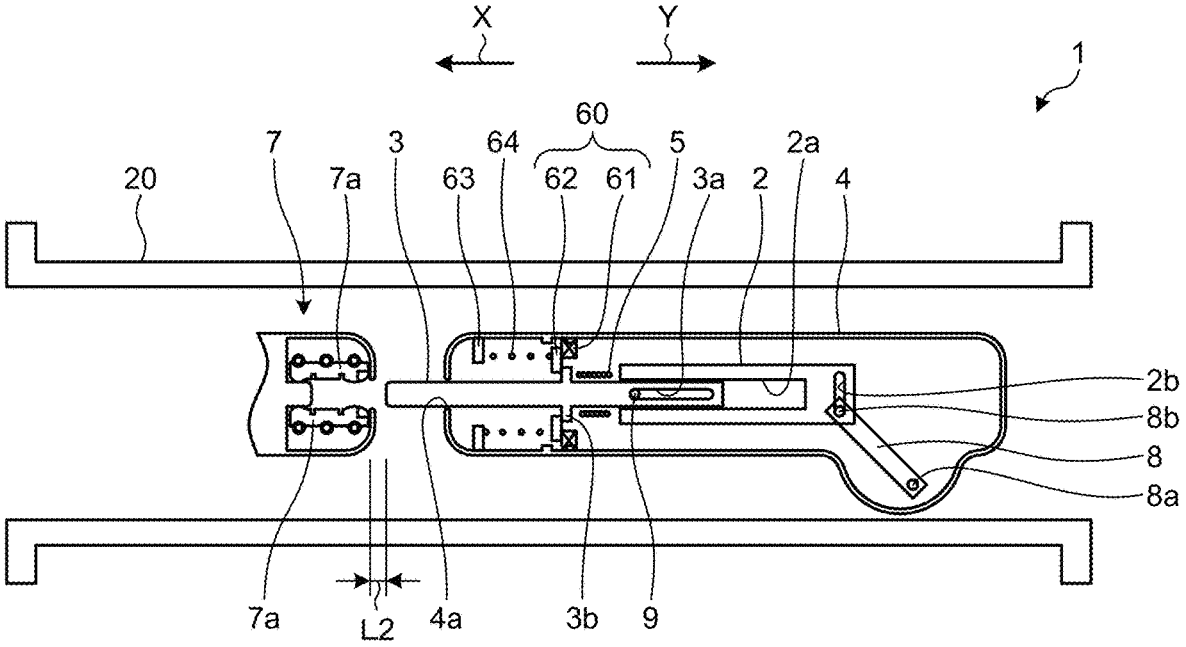
FIG. 3 is a cross-sectional view explaining the closing operation in the switchgear according to the first embodiment.
Figure 4:
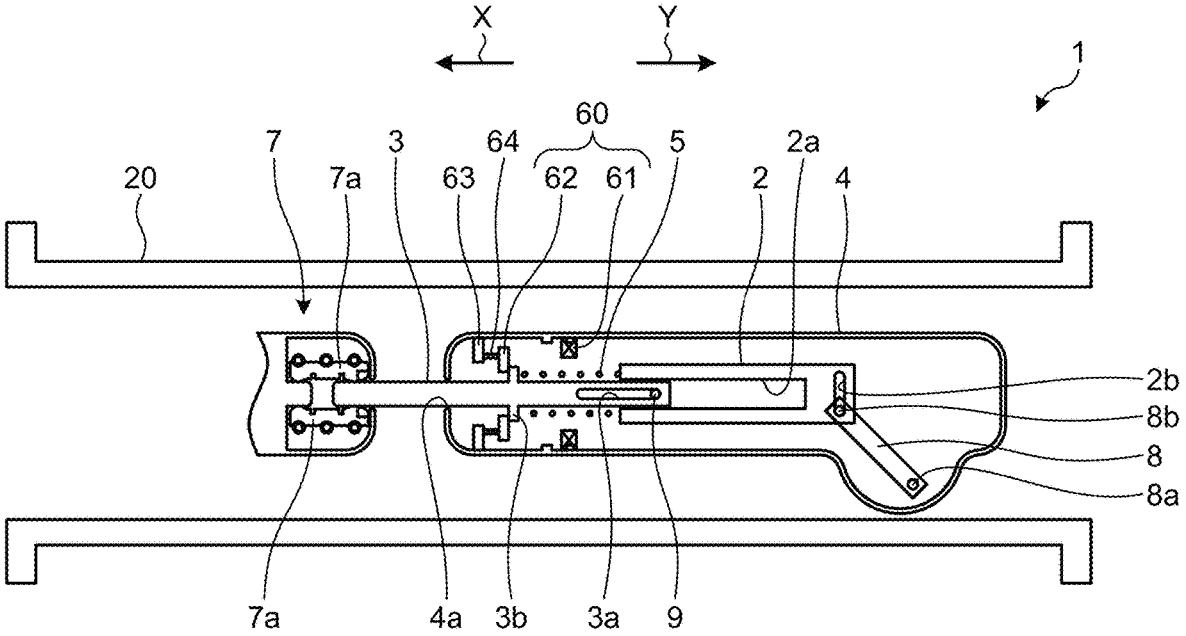
FIG. 4 is a cross-sectional view explaining the closing operation in the switchgear according to the first embodiment.
Figure 5:
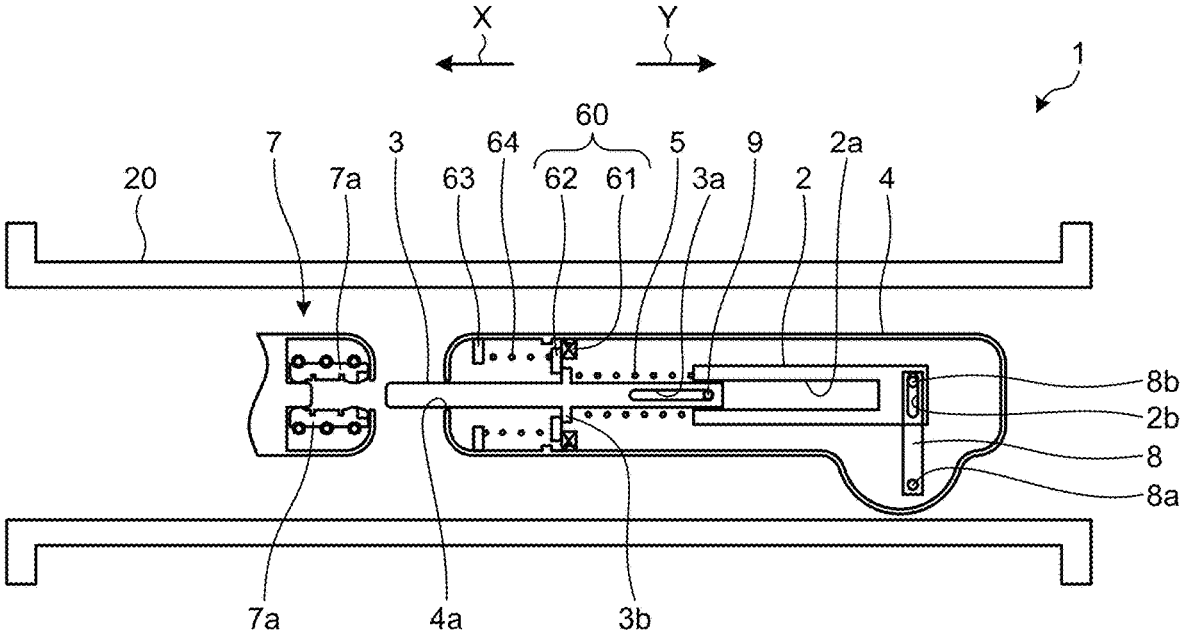
FIG. 5 is a cross-sectional view explaining opening operation in the switchgear according to the first embodiment.
Figure 6:
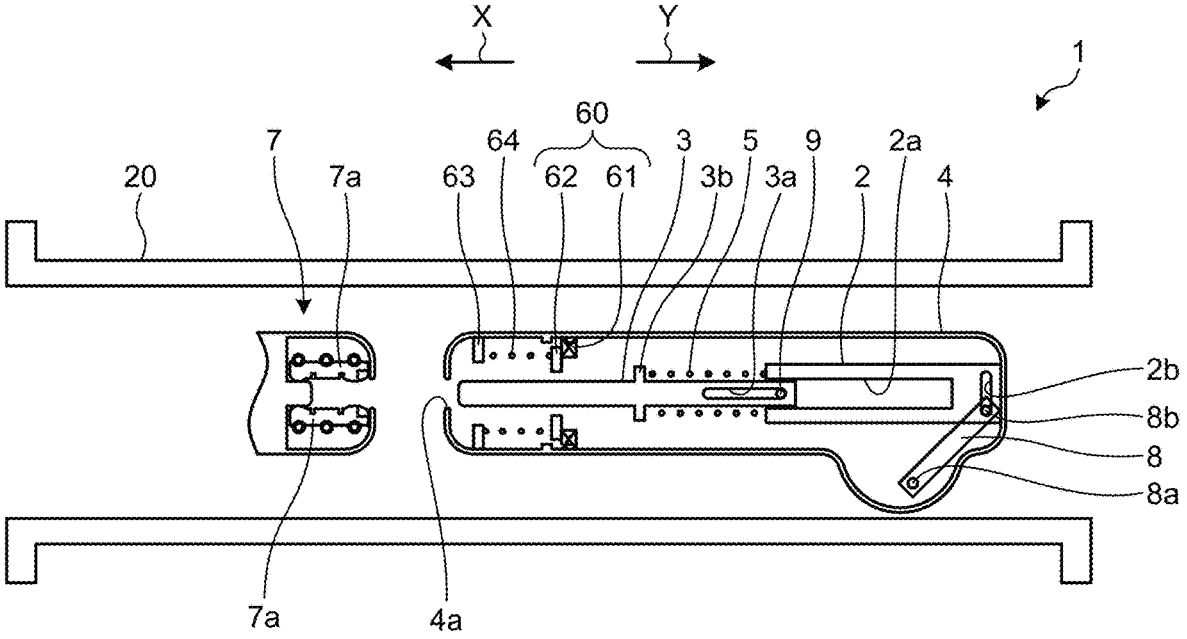
FIG. 6 is a cross-sectional view explaining the opening operation in the switchgear according to the first embodiment.

FIG. 1 is a cross-sectional view illustrating a schematic configuration of a switchgear according to a first embodiment of the present invention. FIGS. 2 to 4 are cross-sectional views explaining closing operation in the switchgear according to the first embodiment. FIGS. 5 and 6 are cross-sectional views explaining opening operation in the switchgear according to the first embodiment. A switchgear 1, which is a grounding switch, is used in a tank 20 in which insulating gas having electrically insulating and arc-extinguishing properties, such as sulfur hexafluoride ($SF_6$) gas is enclosed. The switchgear 1 includes a movable part 2, a movable contact 3, a first spring 5, a frame 4, a latch part 60, a counter plate 63, a second spring 64, a fixed contact 7, a lever 8, and a motor 14.

The movable part 2 is capable of reciprocating movement toward a direction indicated by an arrow X, which is a first direction, and toward a direction indicated by an arrow Y, which is a second direction opposite to the first direction. The movable part 2 has a hole 2*a* extending from an end thereof on the side of the direction indicated by the arrow X toward the direction indicated by the arrow Y. A pin 9 is provided inside the hole 2*a* of the movable part 2. A groove 2*b* extending in a direction perpendicular to the moving direction of the movable part 2 is formed on the movable part 2.

The movable contact 3 is located on the side of the direction indicated by the arrow X with respect to the movable part 2 and coupled to movable part 2. More specifically, an end of the movable contact 3 on the side of the direction indicated by the arrow Y is inserted in the hole 2*a* of the movable part 2. Because the movable contact 3 is inserted in the hole 2*a*, the movable contact 3 is capable of reciprocating movement relative to the movable part 2 toward the direction indicated by the arrow X and toward the direction indicated by the arrow Y.

A groove 3*a* extending along the moving direction of the movable contact 3 is formed at an end on the side of the direction indicated by the arrow Y of the movable contact 3. The pin 9 provided inside the hole 2*a* of the movable part 2 is inserted in the groove 3*a*. The pin 9 is caught by an end of the groove 3*a*, which prevents the movable contact 3 from moving excessively in the direction indicated by the arrow X and falling off from the hole 2*a*. The movable contact 3 has a projecting portion 3*b* projecting in a direction perpendicular to the moving direction. Note that, in the following description, part of the movable contact 3 on the side of the direction indicated by the arrow X with respect to the projecting portion 3*b* will be referred to as a distal part, and part of the movable contact 3 on the side of the direction indicated by the arrow Y with respect to the projecting portion 3*b* will be referred to as a base part. Thus, the groove 3*a* mentioned above is formed on the base part of the movable contact 3. In addition, the distal part of the movable contact 3 serves as a contact brought in contact with the fixed contact 7 as the movable contact 3 moves in the direction indicated by the arrow X.

The first spring 5 is a helical compression spring provided between an end face of the movable part 2 on the side of the direction indicated by the arrow X and the projecting portion 3*b* of the movable contact 3. The first spring 5 is a first biasing member that biases the movable contact 3 in the direction indicated by the arrow X relative to the movable part 2. As described above, even when the movable contact 3 is moved in the direction indicated by the arrow X by the biasing force of the first spring 5, the pin 9 is caught by the end of the groove 3*a* of the movable contact 3, and thus the movable contact 3 does not fall off from the hole 2*a* of the movable part 2.

The frame 4 is an accommodating part that accommodates the movable part 2 and the movable contact 3 therein. The frame 4 has an opening 4*a* through which the distal part of the movable contact 3 can pass. The distal part of the movable contact 3 protrudes outside of the frame 4 through the opening 4*a* as the movable contact 3 moves in the direction indicated by the arrow X.

As illustrated in FIG. 1, the latch part 60 is located on the side of the direction indicated by the arrow X with respect to the projecting portion 3*b* of the movable contact 3 in a state in which the movable part 2 and the movable contact 3 are at positions after having moved in the direction indicated by the arrow Y. Note that the positions of the movable part 2 and the movable contact 3 in a state in which the movable contact 3 is away from the fixed contact 7 as illustrated in FIG. 1 will be referred to as initial positions.

The latch part 60 includes a magnet 61 fixed to the frame 4, and a metallic member 62 that is attracted by the magnet 61 from the side of the direction indicated by the arrow X relative to the magnet 61 when the movable part 2 and the movable contact 3 are at the initial positions.

The metallic member 62 is an annular plate member. An opening formed at the center of the metallic member 62 is an opening having such a size that allows passage of the distal part of the movable contact 3 therethrough but does not allow passage of the projecting portion 3*b*.

As illustrated in FIG. 2, as the movable contact 3 moves from the initial position in the direction indicated by the arrow X, the projecting portion 3*b* of the movable contact 3 comes into contact with part of the metallic member 62 avoiding the magnet 61 from the side of the direction indicated by the arrow Y, which restricts further movement of the movable contact 3 in the direction indicated by the arrow X. In this manner, the projecting portion 3*b* functions as an abutment portion that comes into contact with the metallic member 62 from the side of the direction indicated by the arrow Y. In addition, a state of the latch part 60 capable of restricting the movement of the movable contact 3 in the direction indicated by the arrow X will be referred to as a first state. Specifically, a state in which the metallic member 62 is attracted by the magnet 61 is the first state. At the initial positions, however, the projecting portion 3*b* is not in contact with the metallic member 62 of the latch part 60, and the movement of the movable contact 3 is not restricted although the latch part 60 is in the first state.

The latch part 60 is switchable to a second state in which the movement of the movable contact 3 in the direction indicated by the arrow X is permitted. Specifically, the second state in which the movement of the movable contact 3 in the direction indicated by the arrow X is permitted is a state in which the metallic member 62 is separated from the magnet 61 against the attractive force toward the magnet 61.

The counter plate 63 is located inside the frame 4 and on the side of the direction indicated by the arrow X with respect to the metallic member 62. The counter plate 63 is fixed to the inside of the frame 4 and faces the metallic member 62. A second spring 64 is provided on the counter plate 63 on the side of the direction indicated by the arrow Y. The second spring 64 is a helical compression spring having an end on the side of the direction indicated by the arrow X fixed to the counter plate 63. The metallic member 62 is fixed to an end of the second spring 64 on the side of the direction indicated by the arrow Y. The second spring 64 is a second biasing member that biases the metallic member 62 in the direction indicated by the arrow Y. The second spring 64 has a spring constant smaller than that of the first spring 5.

The lever 8 is a rod-like member located inside the frame 4 and being rotatable about a shaft 8*a*. The lever 8 includes a pin 8*b* inserted in the groove 2*b* of the movable part 2. As the lever 8 turns with the pin 8*b* being inserted in the groove 2*b*, the movable part 2 moves linearly in the direction indicated by the arrow X or the direction indicated by the arrow Y.

A first pulley 11 is coupled to the shaft 8*a*. The lever 8 turns with the first pulley 11. The first pulley 11 is supported by a first base 15. A second pulley 12 is provided at a position away from the first pulley 11. The second pulley 12 is turned by the motor 14. The second pulley 12 is supported by a second base 16. Two flexible jackets 13*a* are provided between the first base 15 and the second base 16. The flexible jackets 13*a* have flexibility and a cylindrical shape in which wires 13*b* are inserted. A flexible jacket 13*a* and a wire 13*b* constitute a wire mechanism 13. Each of the flexible jackets 13*a* has one end fixed to the first base 15 and the other end fixed to the second base 16. The wires 13*b* inserted in the flexible jackets 13*a* are slidable along the extending direction of the flexible jackets 13*a*. In addition, the wires 13*b* have a loop shape and are looped around the first pulley 11 and the second pulley 12. As the second pulley 12 turns, the wires 13*b* slide, which causes the first pulley 11 to turn with the turning of the second pulley 12. Thus, as the second pulley 12 is turned by the motor 14, the first pulley 11 and the lever 8, and the movable part 2 moves. In this manner, the motor 14 functions as a driver that moves the movable part 2. In an operating device, the wires 13*b* are slidable along the shapes of the flexible jackets 13*a* between the first pulley 11 and the second pulley 12. Thus, even in a case where the shapes of the flexible jackets 13*a* are changed, the first pulley 11 can be turned with the turning of the second pulley 12. Thus, the shapes of the flexible jackets 13*a* can be changed, so that the second pulley 12 and the motor 14 can be installed at various positions.

The fixed contact 7 is located on the side of the direction indicated by the arrow X with respect to the movable contact 3. The fixed contact 7 has a plurality of contact points 7*a*. As illustrated in FIG. 4, when the distal part of the movable contact 3 is inserted between the contact points 7*a*, the fixed contact 7 and the movable contact 3 come into contact with each other. In a case where the switchgear 1 is a grounding switch in which the fixed contact 7 is on the main circuit side and the movable contact 3 is on the grounding side, the main circuit is grounded when the fixed contact 7 and the movable contact 3 are in contact with each other. As illustrated in FIG. 4, the positions of the movable part 2 and the movable contact 3 in a state in which the movable contact 3 is in contact with the fixed contact 7 will be referred to as closed positions.

Next, closing operation in which the movable part 2 and the movable contact 3 move from the initial positions to the closed positions will be explained. As the movable part 2 and the movable contact 3 move a predetermined distance from the initial positions illustrated in FIG. 1 in the direction indicated by the arrow X as illustrated in FIG. 2, the projecting portion 3*b* of the movable contact 3 comes into contact with the metallic member 62 of the latch part 60, which restricts further movement of the movable contact 3 in the direction indicated by the arrow X.

Subsequently, as the movable part 2 moves further in the direction indicated by the arrow X against the biasing force of the first spring 5 in the state in which the movement of the movable contact 3 in the direction indicated by the arrow X is restricted, the first spring 5 is compressed and the force thereof is accumulated as illustrated in FIG. 3. When the force accumulated in the first spring 5 exceeds the attractive force between the magnet 61 and the metallic member 62, the state is switched to the second state in which the metallic member 62 is away from the magnet 61 and the movement of the movable contact 3 in the direction indicated by the arrow X is permitted as illustrated in FIG. 4. In this process, because the spring constant of the second spring 64 is smaller than that of the first spring 5, the force accumulated in the first spring 5 is released, and the movable contact 3 moves in the direction indicated by the arrow X at a speed higher than the moving speed of the movable part 2 before the release. The distal part of the movable contact 3 is then inserted between the contact points 7*a* of the fixed contact 7, which will be described later, the movable contact 3 and the fixed contact 7 come into contact with each other, and the closing operation is thus completed. The positions of the movable part 2 and the movable contact 3 in the state in which the movable contact 3 is in contact with the fixed contact 7 are referred to as closed positions.

Next, opening operation in which the movable part 2 and the movable contact 3 move from the closed positions to the initial positions will be explained. As illustrated in FIG. 5, as the movable part 2 moves in the direction indicated by the arrow Y, the movable contact 3 is caught by the pin 9 and thus also moves in the direction indicated by the arrow Y. As a result, the movable contact 3 is separated from the fixed contact 7. In this process, the metallic member 62 moves together with the movable contact 3 in the direction indicated by the arrow Y by the biasing force of the second spring 64.

As the movable part 2 and the movable contact 3 move further in the direction indicated by the arrow Y, the movable part 2 and the movable contact 3 return to the initial positions as illustrated in FIG. 6. In this process, when the metallic member 62 is attracted by the magnet 61 and restored to the first state, further movement in the direction indicated in the arrow Y is restricted.

In the switchgear 1 having the configuration as described above, the movable part 2 and the movable contact 3 do not move at high speeds until the movement of the movable contact 3 becomes restricted and the force is accumulated in the first spring 5 as illustrated in FIG. 3. Subsequently, as illustrated in FIG. 4, when the latch part 60 is switched to the second state, the movable contact 3 moves at high speeds.

The distance L1 between the movable contact 3 and the fixed contact 7 at the initial positions is set to such a distance with which an arc is less likely to occur between the movable contact 3 and the fixed contact 7 even when an abnormal voltage exceeding a steady state is applied to a main circuit connected with the fixed contact 7, such as when the main circuit is hit by lightning, for example. In addition, the distance L2 between the movable contact 3 and the fixed contact 7 in the state in which the movement is restricted by the latch part 60, that is, in the state illustrated in FIGS. 2 and 3 is set to such a distance with which no arc occurs when a steady state voltage is applied to a main circuit connected with the fixed contact 7 and which is shorter than the distance L1.

Thus, in a process of moving the movable contact 3 from the initial position to a position where the distance to the fixed contact 7 is L2 and thereafter accumulating the force in the first spring 5, no arc will occur in a state in which the a steady state voltage is applied to the main circuit, and the movable part 2 and the movable contact 3 may therefore be moved at low speeds. This enables the driving force for moving the movable part 2 to be reduced. As a result, the operating device for moving the movable part 2 can be constituted by the first pulley 11, the second pulley 12, the wire mechanisms 13, and the motor 14, which enables reduction in size as compared to an operating device in which the motor 14 and the lever 8 are connected by a rigid member therebetween. In addition, the lengths of the flexible jackets 13*a* and the wires 13*b* can be changed and the shapes of the flexible jackets 13*a* can be changed, which enables the second pulley 12 and the motor 14 to be placed at various positions. As a result, the second pulleys 12 and the motors 14 of a plurality of operating devices can be placed together, which improves the maintenance efficiency. Note that looping of a plurality of wires 13*b* around the second pulley 12 enables turning of a plurality of first pulleys 11 by one motor 14, that is, movement of a plurality of movable parts 2 and movable contacts 3 by one motor 14, which further improves the maintenance efficiency and reduces the size of the operating device. Note that, in FIGS. 2 to 6, the operating device is not illustrated.

In addition, in a range in which the distance between the movable contact 3 and the fixed contact 7 is shorter than L2, that is, in a range in which an arc may occur, the movable contact 3 can be moved at high speeds with se of the force accumulated in the first spring 5. Thus, in the range in which an arc may occur, the movable contact 3 is moved at high speeds so that the movable contact 3 is brought into contact with the fixed contact 7 in a shorter time, which shortens the duration of an arc.

As described above, in the switchgear 1, the movable contact 3 is moved at high speeds only in the range in which arc may occur in the state in which a steady state voltage is applied to the main circuit, less energy is required of the operating device than a case where the movable contact 3 is moved at high speeds in all ranges from the initial positions to the closed positions. Thus, use of the pulleys and the like as described above enables reduction in the size of the operating device.

In addition, the switching from the first state to the second state of the latch part 60 is made using the attractive force between the magnet 61 and the metallic member 62, and the switching from the second state to the first state of the latch part 60 is made using the biasing force of the second spring 64, which enables simplification of structure as compared to a mechanism using electronic control for switching between states.

Second Embodiment

Figure 7:
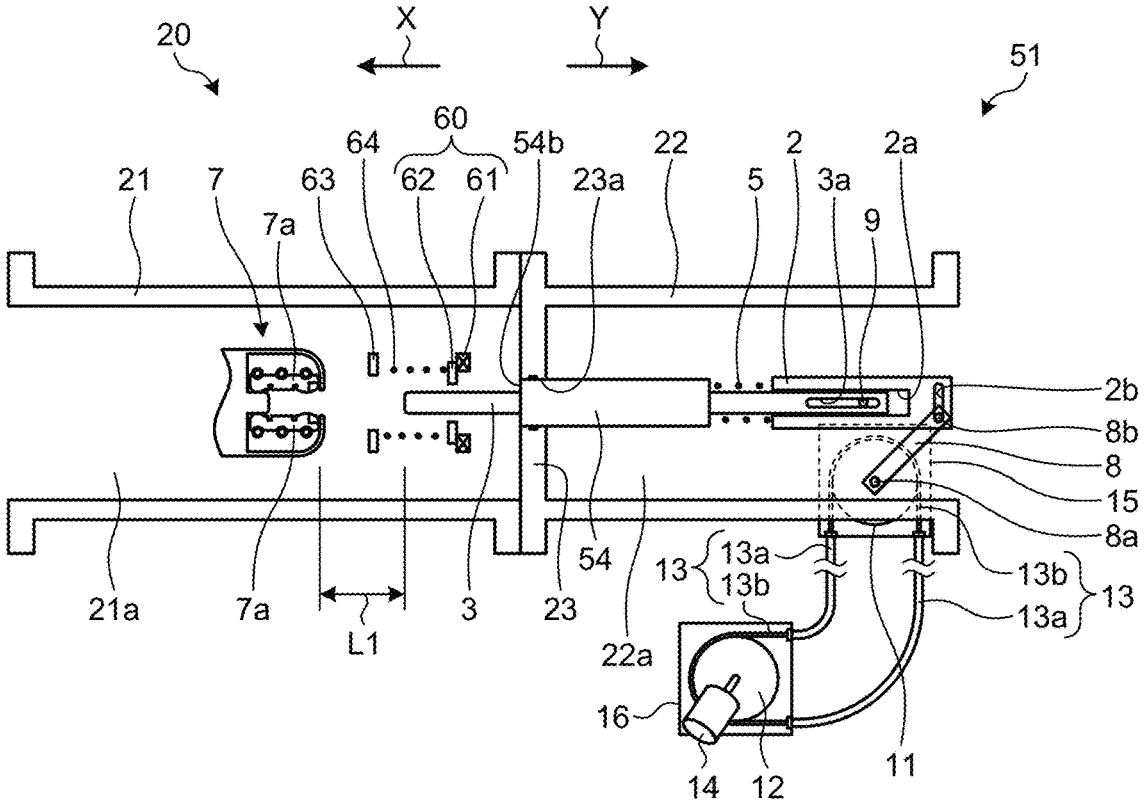
FIG. 7 is a cross-sectional view illustrating a schematic configuration of a switchgear according to a second embodiment of the present invention.
Figure 8:
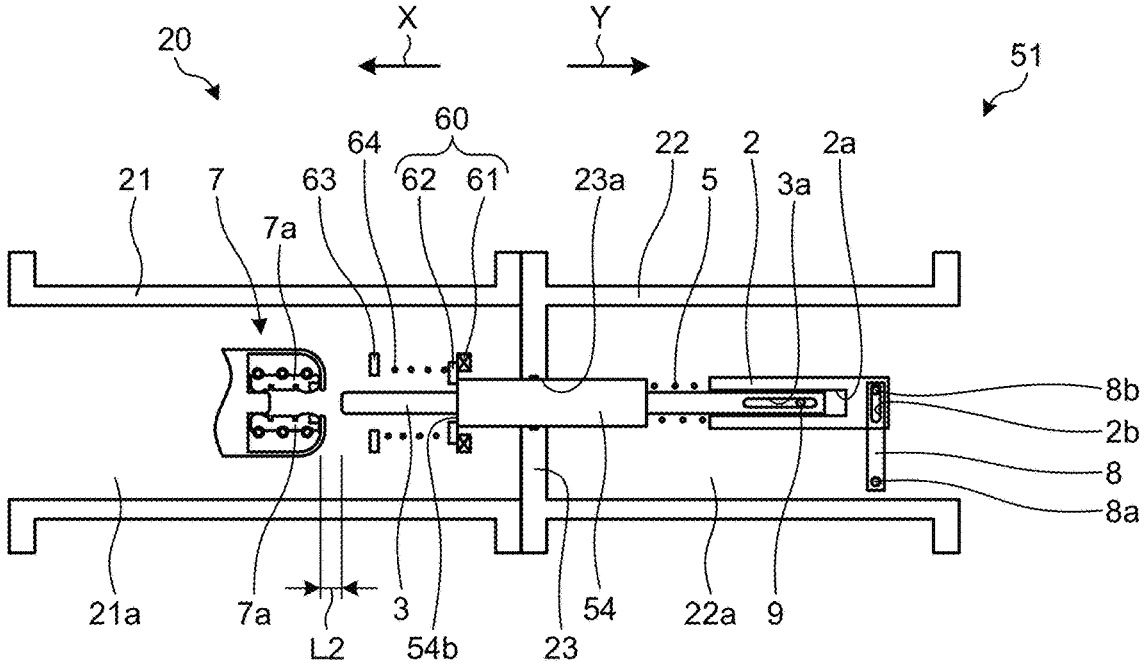
FIG. 8 is a cross-sectional view explaining closing operation in the switchgear according to the second embodiment.
Figure 9:
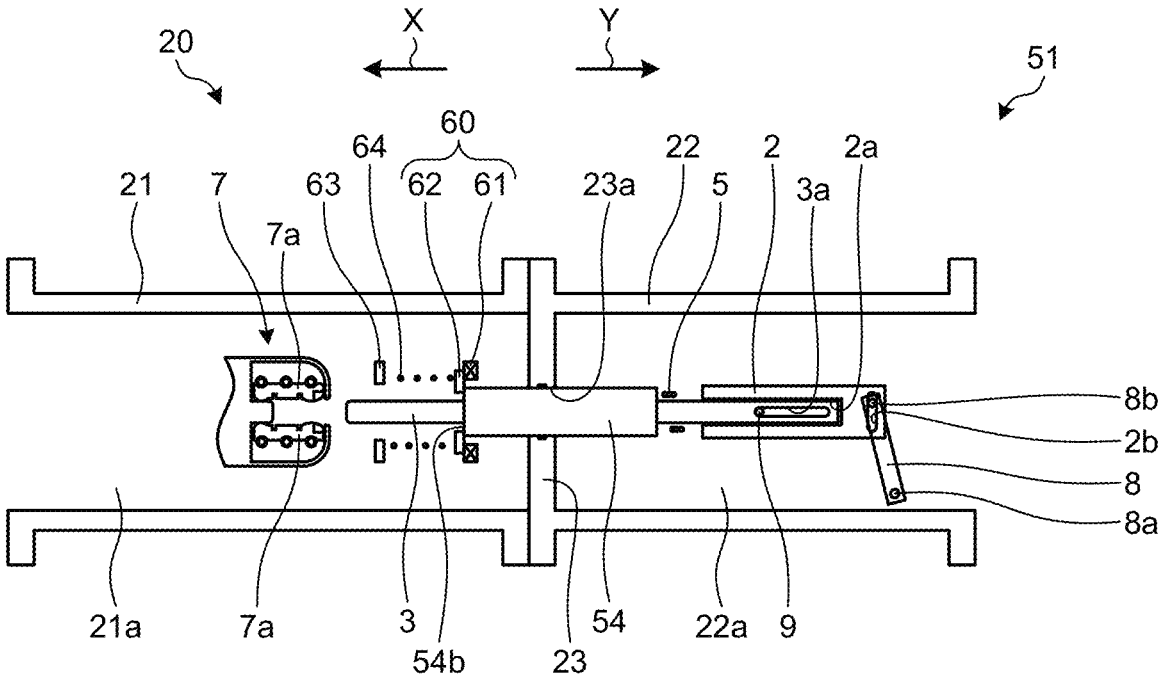
FIG. 9 is a cross-sectional view explaining the closing operation in the switchgear according to the second embodiment.
Figure 10:
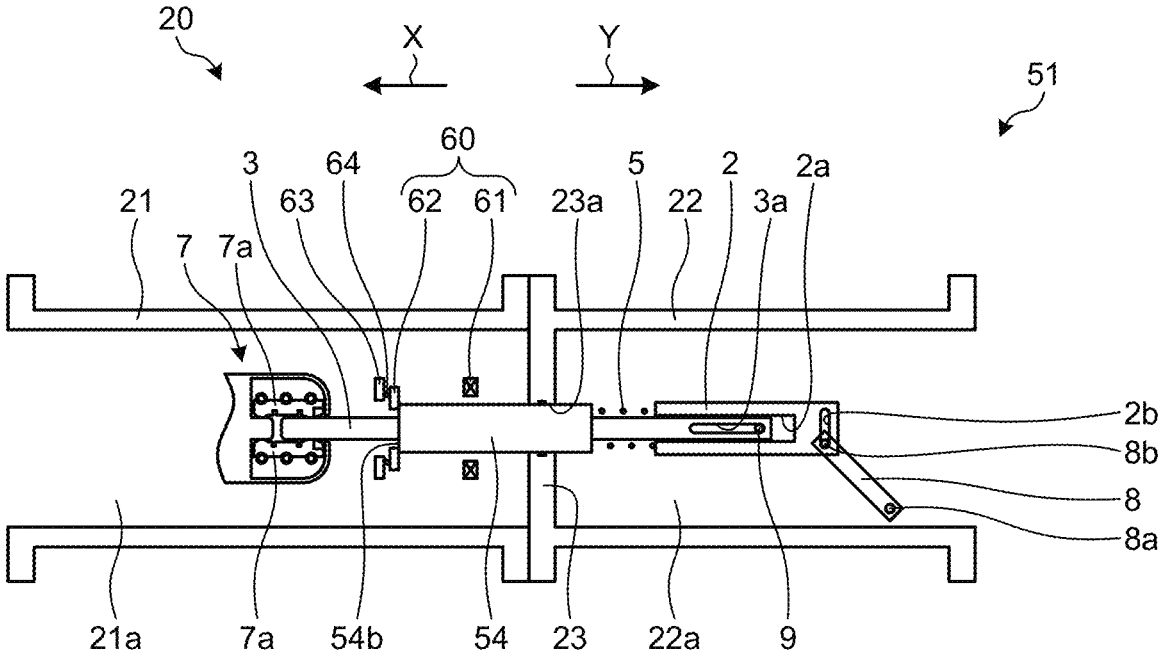
FIG. 10 is a cross-sectional view explaining the closing operation in the switchgear according to the second embodiment.
Figure 11:
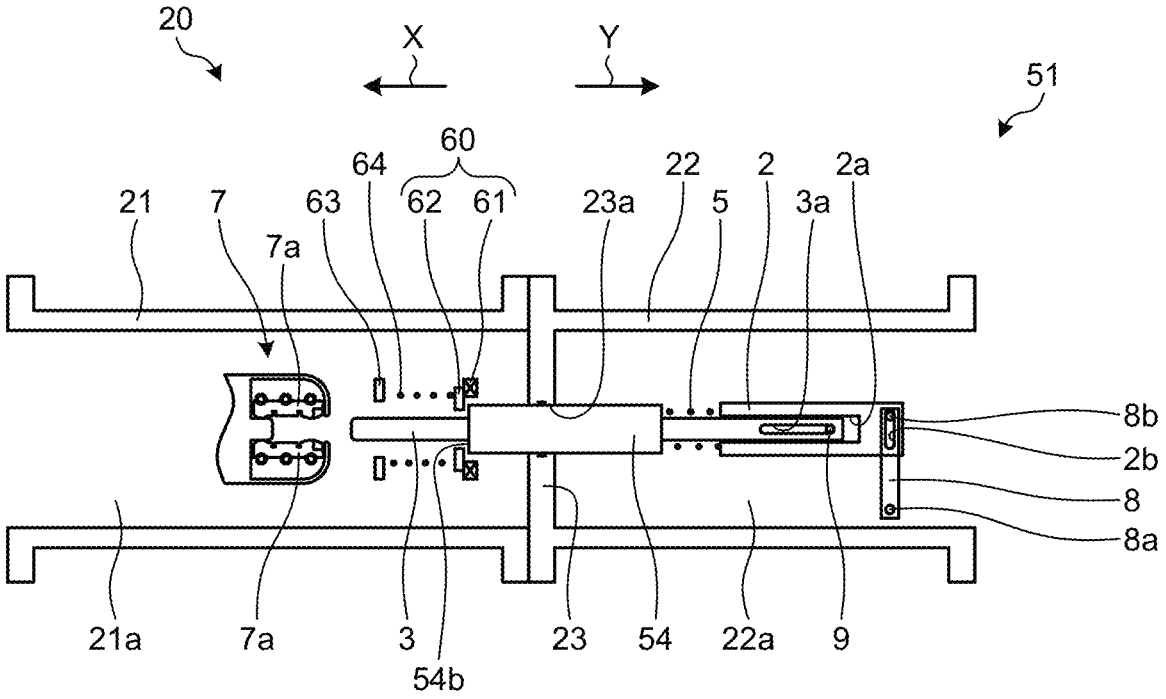
FIG. 11 is a cross-sectional view explaining opening operation in the switchgear according to the second embodiment.
Figure 12:
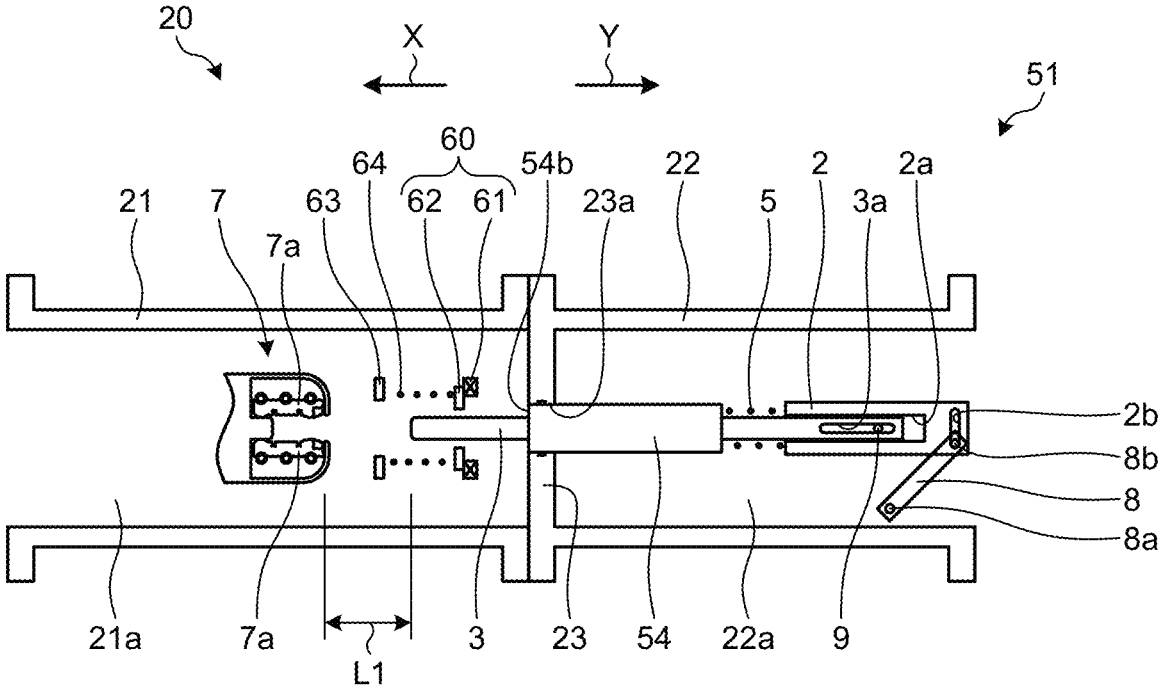
FIG. 12 is a cross-sectional view explaining the opening operation in the switchgear according to the second embodiment.

FIG. 7 is a cross-sectional view illustrating a schematic configuration of a switchgear according to a second embodiment of the present invention. FIGS. 8 to 10 are cross-sectional views explaining closing operation in the switchgear according to the second embodiment. FIGS. 11 and 12 are cross-sectional views explaining opening operation in the switchgear according to the second embodiment. Note that components similar to the components in the first embodiment described above will be represented by the same reference numerals, and detailed description thereof will not be repeated. In addition, in FIGS. 8 to 12, the operating device is not illustrated.

In a switchgear 51 according to the second embodiment, the movable part 2 and the movable contact 3 are accommodated directly in the tank 20 without being covered by the accommodating part. In addition, the switchgear 51 includes a partition wall 23 that divides the inside of the tank 20 into a first space 21*a* and a second space 22*a*. Note that the first space 21*a* is surrounded by a first tank 21 constituting part of the tank 20 and the partition wall 23. The second space 22*a* is surrounded by a second tank 22 constituting part of the tank 20 and the partition wall 23.

The pressure in the first space 21*a* is higher than that in the second space 22*a*. For example, the charged pressure of the insulating gas in the first space 21*a* is set to be higher than that in the second space 22*a*. Alternatively, the second space 22*a* may be open to the atmosphere.

The partition wall 23 has a through-hole 23*a* through which the movable contact 3 passes. A linear seal 54 that allows reciprocating movement of the movable contact 3 while ensuring airtightness between the first space 21*a* and the second space 22*a* is provided on a part, which passes through the partition wall 23, of the movable contact 3. In a state in which the pressure in the first space 21*a* is higher than that in the second space 22*a*, a biasing force toward the second space 22*a* with a lower pressure, that is, a biasing force in the direction indicated by the arrow Y is applied to the linear seal 54 provided at the partition wall 23.

In the switchgear 51 having the configuration as described above, as the movable part 2 and the movable contact 3 move a predetermined distance from the initial positions in the direction indicated by the arrow X during the closing operation, one end 54*b* of the linear seal 54 comes into contact with the metallic member 62 as illustrated in FIG. 8. Thus, the linear seal 54 also functions as an abutment portion that comes into contact with the metallic member 62 from the side of the direction indicated by the arrow Y. In a manner similar to the first embodiment, because the metallic member 62 is attracted by the magnet 61 and thus becomes the first state, further movement of the movable contact 3 in the direction indicated by the arrow X is restricted.

Subsequently, as the movable part 2 moves further in the direction indicated by the arrow X against the biasing force of the first spring 5 in the state in which the movement of the movable contact 3 in the direction indicated by the arrow X is restricted, the first spring 5 is compressed and the force thereof is accumulated as illustrated in FIG. 9. When the force accumulated in the first spring 5 exceeds the attractive force between the magnet 61 and the metallic member 62, the state is switched to the second state in which the metallic member 62 is away from the magnet 61 and the movement of the movable contact 3 in the direction indicated by the arrow X is permitted as illustrated in FIG. 10. As a result, the force accumulated in the first spring 5 is released, and the movable contact 3 moves in the direction indicated by the arrow X at a speed higher than the moving speed of the movable part 2 before the release. The distal part of the movable contact 3 is then inserted between the contact points 7*a*, the movable contact 3 and the fixed contact 7 come into contact with each other, and the closing operation is thus completed.

Next, opening operation in which the movable part 2 and the movable contact 3 move from the closed positions to the initial positions will be explained. As illustrated in FIG. 11, as the movable part 2 moves in the direction indicated by the arrow Y, the movable contact 3 is caught by the pin 9 and thus also moves in the direction indicated by the arrow Y. In this process, the movement of the movable contact 3 in the direction indicated by the arrow Y is also assisted by the biasing force applied to the linear seal 54. As a result, the movable contact 3 is separated from the fixed contact 7. In this process, the metallic member 62 moves together with the movable contact 3 in the direction indicated by the arrow Y by the biasing force of the second spring 64.

As the movable part 2 and the movable contact 3 move further in the direction indicated by the arrow Y, the movable part 2 and the movable contact 3 return to the initial positions as illustrated in FIG. 12. In this process, when the metallic member 62 is attracted by the magnet 61 and restored to the first state, further movement in the direction indicated in the arrow Y is restricted.

In the switchgear 51 according to the second embodiment as well, in a manner similar to the first embodiment, the movable part 2 and the movable contact 3 do not move at high speeds until the movement of the movable contact 3 becomes restricted and the force is accumulated in the first spring. Subsequently, when the latch part 60 is switched to the second state, the movable contact 3 moves at high speeds.

This shortens the duration of an arc while reducing the size of the operating device and improve the maintenance efficiency.

In addition, in the process of the opening operation, the movement of the movable contact 3 in the direction indicated by the arrow Y is also assisted by the biasing force applied to the linear seal 54, which reduces the driving force for moving the movable part 2. This enables reduction of the size of the operating device including the first pulley 11, the second pulley 12, the wire mechanisms 13, and the motor 14, for moving the movable part 2.

Note that, during the closing operation, when the latch part 60 becomes the second state, the movable contact 3 moves at high speeds. Thus, if the pin 9 hits the end of the groove 3*a* at completion of the closing operation illustrated in FIG. 10, the movable contact 3 or the pin 9 may be damaged. Thus, to prevent the pin 9 from hitting the end of the groove 3*a* and prevent damage on the movable contact 3 or the pin 9, a gap may be provided between the end of the groove 3*a* on the side of the direction indicated by the arrow Y and the pin 9 at completion of the closing operation illustrated in FIG. 10.

In a case of the configuration in which a gap is provided between the end of the groove 3*a* on the side of the direction indicated by arrow Y and the pin 9 at completion of the closing operation, the gap is provided between the end of the groove 3*a* on the side of the direction indicated by arrow Y and the pin 9 at the initial positions. Thus, in a case where no linear seal 54 is provided, the following operation is needed in the process of returning from the closed positions to the initial positions.

First, in the opening operation, the pin 9 of the movable part 2 is caught by the end of the groove 3*a*, so that the movable contact 3 is moved in the direction indicated by the arrow Y, and the movable contact 3 is moved to the position corresponding to the initial position. Subsequently, only the movable part 2 needs to be moved in the direction indicated by the arrow X to a position corresponding to the initial position, so that the pin 9 is separated from the end of the groove 3*a* on the side of the direction indicated by the arrow Y. In this operation, the movable part 2 needs to be moved to a position further in the direction indicated by the arrow Y than the initial position and then moved in the direction indicated by the arrow X to return to the initial position. Note that, to achieve this operation, it is necessary that movable part 2 and the movable contact 3 do not move integrally until the movable part 2 moves from the position at which the end of the groove 3*a* on the side of the direction indicated by the arrow Y and the pin 9 are in contact with each other to the initial position. For example, the gap may be provided between the movable part 2 and the first spring 5 in a state in which the end of the groove 3*a* on the side of the direction indicated by the arrow Y and the pin 9 are in contact with each other.

In contrast, in the second embodiment in which the linear seal 54 is provide on the movable contact 3, the biasing force is applied to the linear seal 54, when the movable part 2 is moved in the direction indicated by the arrow Y and then moved to the initial position in the opening operation, only the movable contact 3 can further be moved in the direction indicated by the arrow Y and then to the initial position by the biasing force applied to the linear seal 54.

Thus, the movable part 2 need not be further moved in the direction indicated by the arrow Y than the initial position in the opening operation. This narrows the movement range of the movable part 2, which reduces the driving force and the like required of the operating device including the first pulley 11, the second pulley 12, the wire mechanisms 13, and the motor 14, for moving the movable part 2, and reduces the size of the operating device.

While a configuration in which the second spring 64 is provided so as to return the metallic member 62 to the first state is presented in the second embodiment, other configurations such as attraction between the linear seal 54 and the metallic member 62 by magnetic force may be employed and combined with the linear seal 54.

The configurations presented in the embodiments above are examples of the present invention, and can be combined with other known technologies or can be partly omitted or modified without departing from the scope of the present invention.

REFERENCE SIGNS LIST

1 switchgear; 2 movable part; 2*a* hole; 2*b* groove; 3 movable contact; 3*a* groove; 3*b* projecting portion; 4 frame; 4*a* opening; 5 first spring; 7 fixed contact; 7*a* contact point; 8 lever; 9 pin; 11 first pulley; 12 second pulley; 13 wire mechanism; 13*a* flexible jacket; 13*b* wire; 14 motor; 15 first base; 16 second base; 20 tank; 21 first tank; 21*a* first space; 22 second tank; 22*a* second space; 23 partition wall; 23*a* through-hole; 60 latch part; 61 magnet; 62 metallic member; 63 counter plate; 64 second spring.

The invention claimed is:

1. A switchgear comprising:

a movable part capable of reciprocating movement including movement in a first direction and movement in a second direction opposite to the first direction;

a movable contact coupled to the movable part on a side of the first direction, the movable contact being capable of reciprocating movement including movement in the first direction and movement in the second direction relative to the movable part;

a first biasing member to bias the movable contact in the first direction relative to the movable part;

a latch part capable of switching between a first state in which movement of the movable contact in the first direction is restricted and a second state in which movement of the movable contact in the first direction is permitted; and a fixed contact provided on a side of the first direction with respect to the movable contact, wherein the movable part and the movable contact move in the first direction from initial positions at which the movable contact is away from the fixed contact to closed positions at which the movable contact is in contact with the fixed contact, in a process in which the movable part and the movable contact move from the initial positions to the closed positions, after the movable part and the movable contact have moved a predetermined distance, the movement of the movable contact is restricted by the latch part in the first state, and when the movable part has moved further in the first direction against biasing force of the first biasing member after the movement of the movable contact was restricted, the latch part is switched to the second state in which the movement of the movable contact in the first direction is permitted, the latch part includes a magnet, and a metallic member, the metallic member being attracted by the magnet from a side of the first direction when the movable part and the movable contact are at the initial positions, the movable contact includes an abutment portion to come into contact with part of the metallic member avoiding the magnet from a side of the second direction when the movement of the movable contact in the first direction is restricted by the latch part, and the switchgear further comprises a second biasing member to bias the metallic member in the second direction.

2. The switchgear according to claim 1, further comprising:

a partition wall to divide a space surrounding the movable contact into a first space containing the fixed contact, the magnet, and the metallic member, and a second space containing the movable part, wherein the movable contact has a distal end passing through the partition wall and entering the first space, the distal end being an end on a side of the first direction, the movable contact is provided with a linear seal enabling reciprocating movement of the movable contact while ensuring airtightness between the first space and the second space, the linear seal being provided on a part, which passes through the partition wall, of the movable contact, and a pressure in the first space is higher than that in the second space.

3. The switchgear according to claim 2, further comprising: a driver to move the movable part.

4. The switchgear according to claim 1, further comprising: a driver to move the movable part.

5. A switchgear comprising:

a movable part capable of reciprocating movement including movement in a first direction and movement in a second direction opposite to the first direction;

a movable contact coupled to the movable part on a side of the first direction, the movable contact being capable of reciprocating movement including movement in the first direction and movement in the second direction relative to the movable part;

a first biasing member to bias the movable contact in the first direction relative to the movable part;

a latch part capable of switching between a first state in which movement of the movable contact in the first direction is restricted and a second state in which movement of the movable contact in the first direction is permitted; and a fixed contact provided on a side of the first direction with respect to the movable contact, wherein the movable part and the movable contact move in the first direction from initial positions at which the movable contact is away from the fixed contact to closed positions at which the movable contact is in contact with the fixed contact, in a process in which the movable part and the movable contact move from the initial positions to the closed positions, after the movable part and the movable contact have moved a predetermined distance, the movement of the movable contact is restricted by the latch part in the first state, and when the movable part has moved further in the first direction against biasing force of the first biasing member after the movement of the movable contact was restricted, the latch part is switched to the second state in which the movement of the movable contact in the first direction is permitted, the latch part includes a magnet, and a metallic member, the metallic member being attracted by the magnet from a side of the first direction when the movable part and the movable contact are at the initial positions, the movable contact includes an abutment portion to come into contact with part of the metallic member avoiding the magnet from a side of the second direction when the movement of the movable contact in the first direction is restricted by the latch part, the switchgear further comprises a partition wall to divide a space surrounding the movable contact into a first space containing the fixed contact, the magnet, and the metallic member, and a second space containing the movable part, the movable contact has a distal end passing through the partition wall and entering the first space, the distal end being an end on a side of the first direction, the movable contact is provided with a linear seal enabling reciprocating movement of the movable contact while ensuring airtightness between the first space and the second space, the linear seal being provided on a part, which passes through the partition wall, of the movable contact, and a pressure in the first space is higher than that in the second space.

6. The switchgear according to claim 5, further comprising: a driver to move the movable part.

* * * * *